United States Patent [19]

Tsukada et al.

[11] Patent Number: 5,014,491

[45] Date of Patent: May 14, 1991

[54] APPARATUS FOR SEAMING CAN END

[75] Inventors: Shinichi Tsukada, Iwatsuki; Tsutomu Shinomiya; Eiichi Yoshino, both of Sapporo; Shigeki Yoshioka, Otaru; Makoto Fujikawa, Sapporo, all of Japan

[73] Assignee: Hokkai Can Co., Ltd., Tokyo, Japan

[21] Appl. No.: 343,951

[22] Filed: Apr. 27, 1989

[30] Foreign Application Priority Data

Apr. 27, 1988 [JP] Japan ..... 63-102440
Jun. 10, 1988 [JP] Japan ..... 63-141482
Dec. 23, 1988 [JP] Japan ..... 63-323554

[51] Int. Cl.[5] ..... B65B 7/28

[52] U.S. Cl. ..... 53/366; 53/282; 53/308; 74/422; 413/6; 413/52

[58] Field of Search ..... 53/282, 308, 366; 74/29, 89.11, 89.12, 89.17, 89.18, 422; 413/2, 6, 27, 35, 36, 52

[56] References Cited

U.S. PATENT DOCUMENTS 1,400,391 12/1921 Troyer .
1,929,339 10/1933 Troyer et al. ..... 413/27
2,727,481 12/1955 Laxo ..... 413/45 X
2,975,740 3/1961 Smith et al. ..... 413/27
3,245,372 4/1966 Bofinger et al. ..... 413/52 X
3,730,118 5/1973 Del-Frate ..... 413/30
4,152,997 5/1979 Webster ..... 413/52 X
4,691,496 9/1987 Andersen et al. ..... 53/282 X
4,808,053 2/1989 Nagai et al. ..... 413/27 X

*Primary Examiner*—Robert L. Spruill
*Assistant Examiner*—Linda B. Johnson

[57] ABSTRACT

An apparatus for seaming a can end to a filled cylindrical can includes can feed device for supporting the bottom of the can rotatably about its own axis and feeding the can linearly along a travel path at a predetermined speed. A can end holder member is provided for detachably holding the can end directly above the can feed device and holding the can end rotatably about its own axis. A can end feed member is provided for moving the can end holder member to feed the can end in synchronism with the can which is fed by the can feed device. A lifting/lowering member is provided for lowering the can end holder member to hold the can end held by the can end holder member against an open end of the can. A seaming device is provided and extends linearly along the travel path for pressing an end hook of the can end against a flange of the can while the can end against which the can end is held is being fed by the can feed device. The can end holder member and the can feed device are rotated to roll the can end and the can along the seaming device to seam the can end to the can while the end hook of the can end and the flange of the can are being pressed by the seaming device.

42 Claims, 15 Drawing Sheets

50
30
52
33
35
28
34
32
44
45
24
29
21
3
23
61
63
60
25
40
62
26
56
14
27
23b
42
5
53
13
Y
31
41
57
X
4
23a
7
8
17
18
10
2
15
12
11
23c
9
59
37
58
46
66
16
47
64
67
65
22
36

APPARATUS FOR SEAMING CAN END

BACKGROUND OF THE INVENTION

The present invention relates to an apparatus for seaming can ends to cylindrical cans which have been filled with contents.

One known can end seaming machine is disclosed in U.S. Pat. No. 1,929,339. A can after it has been filled with contents is delivered by a belt conveyor, then turned by a timing table, and a can end is placed on the can while the can is being turned and guided by a feed turret. Thereafter, the can is turned by a clincher turret while at the same time the end hook of the can end and the flange of the can are clinched by a clincher mechanism, after which the can end is finally fixed to the can by a double seamer mechanism.

When the filled can is turned by the timing table, the direction of feed of the can is continuously varied, thereby applying centrifugal forces to the contents of the can. At the time the can end is placed over the can, the can is speeded up by the feed turret and hence the contents of the can are subjected to inertia. When the can is turned by the clincher turret while the can end is being clinched to the can, the direction of feed of the can is also varied, and centrifugal forces are imposed on the contents of the can. The higher the speed at which the can is fed, the more difficult it becomes to prevent the contents from jumping out of the can.

According to the current practice in the can making industry, can ends are seamed to cans at a rate of 1,400 to 1,500 cans per minute. When the can end seaming process is performed at such a high speed, it is entirely impossible to prevent the contents from being thrown out of the can under the inertia and centrifugal forces produced at the high feed speed and the varying direction of feed.

If the seaming rate is increased while allowing the contents out of the cans, then the rate of production of cans is increased, but a large quantity of thrown-out contents is wasted and the cost of manufacture of the cans is increased.

U.S. Pat. No. 3,730,118 discloses an apparatus for seaming a can end to a filled can while the can is being horizontally supported and linearly fed at a predetermined speed. According to the disclosed apparatus, the end hook of the can end and the flange of the can are pressed against a linear clincher, and the can end is seamed to the can by rolling the can end and the can along the clincher.

However, the apparatus does not have means for pressing the can end to the can when the can end is crimped onto the can. Therefore, the can end may not reliably be crimped onto the can at times. Another problem is associated with the present trend for the reduction of the thickness or gauge of can ends and cans from the standpoint of providing a saving of the can material. When the end hook of a can end of reduced thickness and the flange of a can of reduced thickness are pressed against the linear clincher to crimp the can end onto the can, the can end and the can tend to be deformed under pressure, and the can end may not be reliably seamed to the can .

The same problem occurs when a metal can end is to be seamed to a can made of a thin plastic sheet.

SUMMARY OF THE INVENTION

It is an object of the present invention to provide an apparatus for seaming a can end to a cylindrical can which has been filled with contents, reliably at a high speed while preventing the contents from being thrown out of the can.

Another object of the present invention is to provide an apparatus for seaming a can end to a can reliably at a high speed even if the can end and the can are made of a thin material.

To achieve the above objects, there is provided in accordance with the present invention an apparatus for seaming a can end to a filled cylindrical can, comprising: can feed means for supporting the bottom of the can rotatably about its own axis and feeding the can linearly along a travel path at a predetermined speed; can end holder means for detachably holding the can end directly above said can feed means and holding the can end rotatably about its own axis; can end feed means for moving said can end holder means to feed the can end in synchronism with the can which is fed by said can feed means; lifting/lowering means for lowering said can end holder means to hold the can end held by said can end holder means against an open end of the can; seaming means extending linearly along said travel path for pressing an end hook of the can end and a flange of the can while the can end against which the can end is held is being fed by said can feed means; and drive means for rotating said can end holder means and said can feed means to roll the can end and the can along said seaming means to seam the can end to the can while the end hook of the can end and the flange of the can are being pressed by aid seaming means.

The can end holder means and said can feed means are rotatable about an axis aligned with the axis of the can when the can end is held against the can.

With the above arrangement, the filled can is horizontally and rotatably supported by the can feed means and fed linearly. While the can is being thus fed, the can end removably held by the can end holder means is lowered by the lifting/lowering means and placed on and held against the can. The flange of the can and the end hook of the can end are then pressed against the seaming means and each other, and rolled along the seaming means and clinched together in synchronism with the feeding of the can and the can end b the can feed means and the can end feed means.

Therefore, the can is linearly and horizontally fed at a prescribed speed until the can end has been provisionally or fully crimped on the can, and the speed an direction of feed are not changed before the can end is crimped to the can.

The speed at which the can and the can end are fed and the speed at which they are rolled can be synchronized by rotating the can end holder means and the can feed means. Thus, the flange of the can and the end hook of the can end can be pressed against the seaming means without substantial slippage.

According to the present invention, moreover, the drive means comprises rotative drive mean for rotating the can end holder means in synchronism with the feeding of the can by the can feed means.

The rotative drive means rolls the can and the can end simultaneously along the seaming means in synchronism with the feed thereof, thus reducing the force tending to press the can end and the can against each other. The flange of the can and the end hook of the can end can therefore be pressed against the seaming means with almost no slippage.

The rotative drive means comprises a pinion gear coaxial with said axis of the can end holder means, and a rack extending along the seaming means for mesh with the pinion gear.

The rotative drive means rolls the can and the can end dependent on the speed at which they are fed by the can feed means and the can end feed means.

Further according to the present invention, the drive means rotates the can feed holder means and the can feed means.

More specifically, the drive means comprises first rotative drive means for rotating the can end holder means and second rotative drive means for rotating the can feed means in synchronism with the rotation of the can end holder means.

The first rotative drive means comprises a first pinion gear coaxial with the axis of the can end holder means, and a first rack extending along the seaming means for mesh with the first pinion gear, and wherein the second rotative drive means comprises a second pinion gear coaxial with the axis of the can feed means, and a second rack extending along the travel path for mesh with the second pinion gear.

The rotative drive means thus arranged will roll the can and the can end simultaneously along the seaming means in synchronism with the feed thereof, so that the force tending to press the can end and the can together is reduced. Therefore, the flange of the can and the end hook of the can end can be pressed against the seaming means without substantial slippage.

In order to hold the first pinion gear and the first rack and the second pinion gear and the second rack in reliable mesh with each other, the first rotative drive means further comprises a first rail extending from an end of the first rack upstream thereof in the travel path, and a first slidable surface coaxial and rotatable with the first pinion gear for positioning the first pinion gear into a position for mesh with the first rack when the first slidable surface engages and slides on the first rail, and the second rotative drive means further comprises a second rail extending from an end of the second rack upstream thereof in the travel path, and a second slidable surface coaxial and rotatable with the second pinion gear for positioning the second pinion gear into a position for mesh with the second rack when the second slidable surface engages and slides on the second rail.

For reliable mesh between the pinion gears and the racks, the first rotative drive means further comprises a first tooth integral and rotatable with the first pinion, and a first engagement member positioned upstream of an end of the first rack in the travel path for rotating the first pinion gear into a position for mesh with the first rack when the first tooth engages the first engagement member, and the second rotative drive means further comprises a second tooth integral and rotatable with the second pinion, and a second engagement member positioned upstream of an end of the second rack in the travel path for rotating the second pinion gear into a position for mesh with the second rack when the second tooth engages the second engagement member.

To effect reliable mesh between the pinion gears and the racks, the first rotative drive means comprises a first pinion gear integral and coaxial with the axis of the can end holder means, and a first rack extending parallel to the seaming means and including a portion with which the first pinion gear starts to mesh, the portion being elastically swingable horizontally, and the second rotative drive means comprises a second pinion gear integral and coaxial with the axis of the can end holder means, and a second rack extending parallel to the seaming means and including a portion with which the second pinion gear starts to mesh, the portion being elastically swingable horizontally.

Furthermore, the first rotative drive means comprises a first roll integral and coaxial with the axis of the can end holder means and having a high coefficient of friction, and a first rail extending parallel to the seaming means and having a high coefficient of friction for frictionally engaging the first roll, and the second rotative drive means comprises a second roll integral and coaxial with the axis of the can end holder means and having a high coefficient of friction, and a second rail extending parallel to the seaming means and having a high coefficient of friction for frictionally engaging the second roll.

The can feed means comprises first can feed means for horizontally supporting the can and feeding the can linearly along a feed path at a predetermined speed, and second can feed means movable on a substantially elliptical endless track having a pair of arcuate tracks and a pair of straight tracks, one of the arcuate tracks extending progressively closer tangentially to the feed path and being joined to the first can feed means, one of the straight tracks extending downstream in the feed path, the second can feed means horizontally supporting the can received from the first can feed means and feeding the can along the straight tracks, the second can feed means being positioned downwardly of the can end feed means and movable in synchronism with the can end feed means.

The the second can feed means and the can end feed means comprise a plurality of feed blocks connected endlessly, each of the feed blocks comprising the can end holder means in an upper portion and a rotatable support table in a lower portion which is part of the second can feed means, the feed blocks being movable along the substantially elliptical track.

The can end holder means and the support table have axes of rotation in the feed block which are aligned with the axis of the can.

The can end holder means is vertically movable with respect to the feed block and normally urged to move upwardly, and means for engaging the can end holder means therealong to lower the can end holder means.

Each of the feed blocks has a first leading guide roller and a second trailing guide roller positioned in juxtaposed relation for guiding the feed block along the substantially elliptical track, the arrangement being such that when the guide rollers are on one of the straight tracks or one of the arcuate paths, the guide rollers are guided along one track and the first guide roller moves from the arcuate track into the straight track, when the second guide roller is in the arcuate track, the first guide roller is guided into an arcuate track extending outwardly of the straight track, when the second guide roller moves from the arcuate track into the straight track and the first roller is in the straight track, the second guide roller is guided into the straight track, when the first guide roller moves from the straight track into the arcuate track and the second guide roller is in the straight track, the first guide roller is guided into a straight track extending inwardly from the arcuate track, when the second guide roller moves from the straight track into the arcuate track and the first guide roller is in the arcuate track, the second guide roller is guided into an arcuate track extending outwardly from the straight track.

Since the can which has been fed by the first can feed means is further fed by the second can feed means, the can be rolled simply by providing the second can feed means with means for rotating the can. Therefore, the seaming apparatus is made small in size.

Because the second can feed means and the can end feed means are moved progressively closer tangentially to the feed path of the first can feed means, the can is transferred from the first can feed means to the second can feed means without changing the speed of feed of the can.

With the second can feed means and the can end feed means being in the form of an endless chain of feed blocks which are movable, both of the means can be moved by a common drive means and made relatively small in size, and the path of movement thereof may include partial arcuate paths.

Where the can end holder means and the support table are rotatable about one axis, they are rendered simple in construction.

The vertically movable can end feed means can be lifted and lowered as the feed blocks are moved.

The first guide rollers and the rails for guiding the feed blocks allow the feed blocks to be moved smoothly along the rails, and prevent the feed blocks from colliding with each other when they are moved from the arcuate track to the straight track or from the straight track to the arcuate track.

The seaming means can provisionally crimp the can end onto the can with a provisional crimping groove thereof, and then crimp the can end as first and second crimping stages of a double-seaming process. Alternatively, the seaming means may have a first crimping groove for a double-seaming process for crimping the can end as the first crimping stage without provisionally crimping the can end, and then preferably crimp the can end as the second crimping stage.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
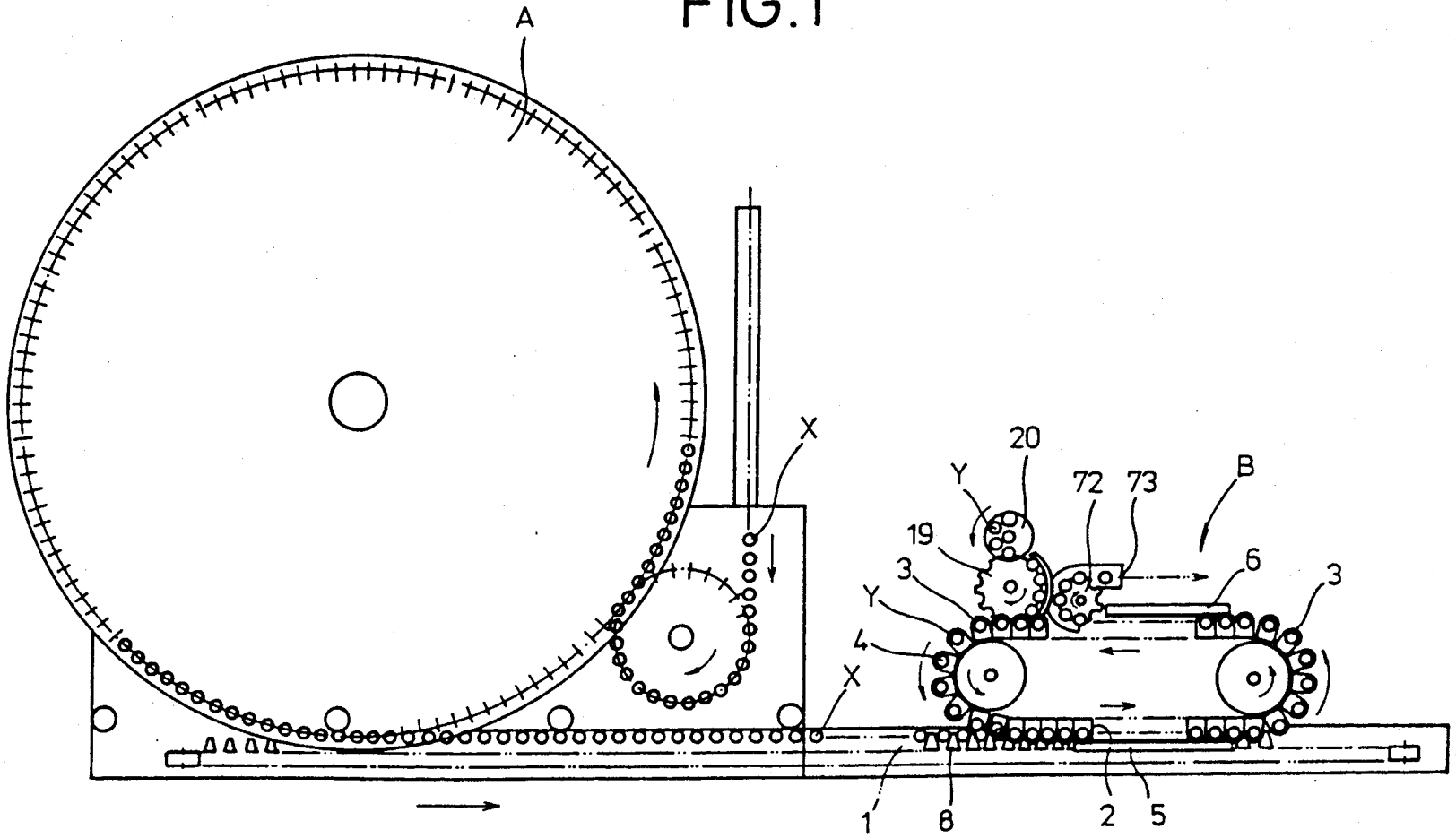
FIG. 1 is a schematic plan view of a can manufacturing system including a seaming apparatus according to an embodiment of the present invention.

FIG. 1 schematically shows a can manufacturing system including a seaming apparatus according to an embodiment of the present invention for double-seaming can ends or covers Y to cans X which are successively supplied from a filling apparatus A by which the cans X are filled with contents.

The seaming apparatus, generally indicated at B, includes a first can feed means 1 for linearly feeding filled cans X from the filling apparatus A horizontally at a predetermined speed, a second endless can feed means 2 rotatable along a substantially elliptical path for feeding cans X, a can end feed means 3 disposed above the second can feed means 2 in confronting relation thereto for feeding can ends or covers Y, a can end holder means 4 for holding can ends Y on the can end feed means 3, a first seaming means 5 disposed parallel to a forward feed path of the second can feed means 2 for feeding cans X linearly, and a second seaming means 6 disposed parallel to a return feed path of the second feed means 2 for feeding cans X linearly.

Figure 2:
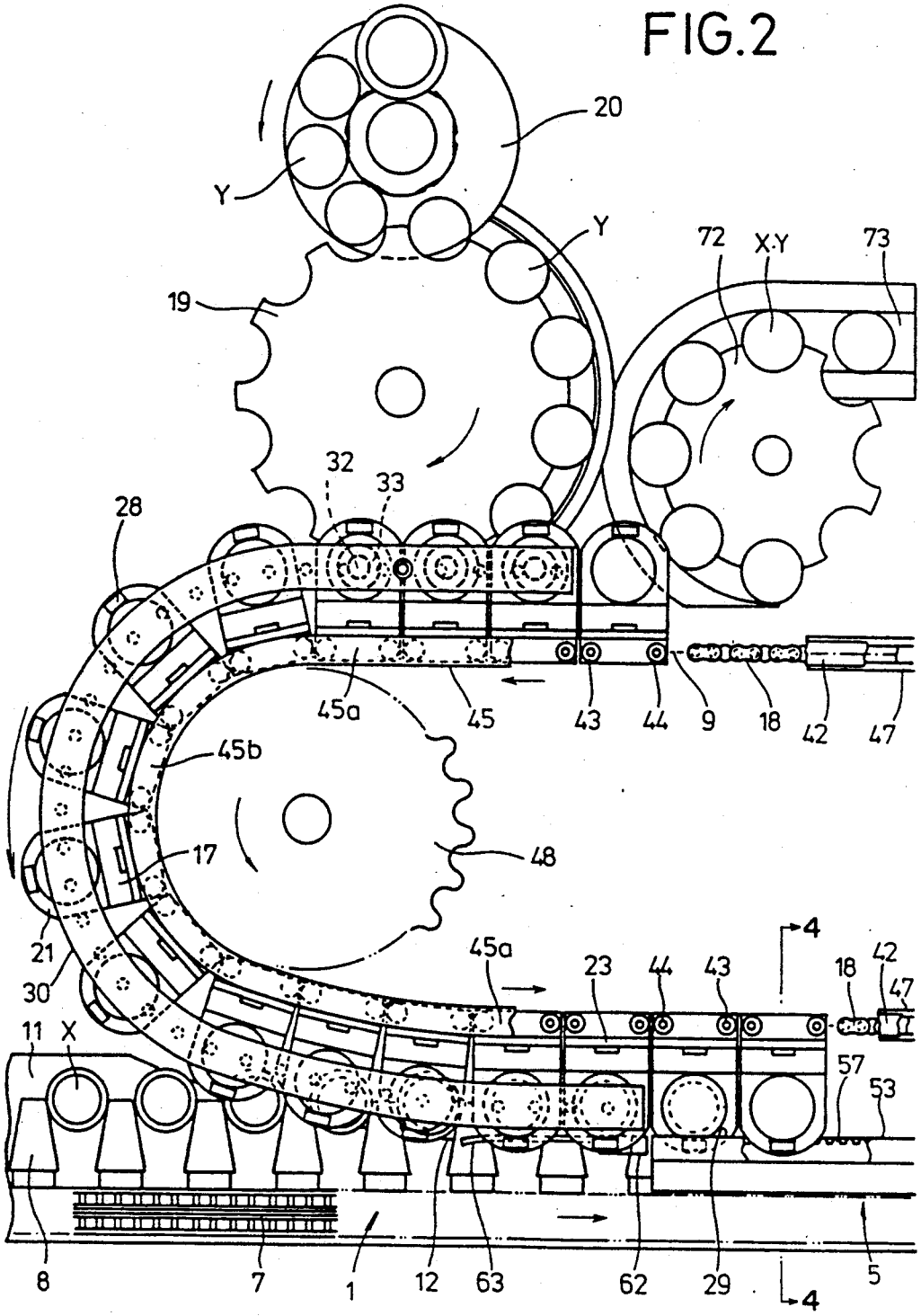
FIGS. 2 and 3 are enlarged fragmentary plan views of the seaming apparatus of the present invention.
Figure 3:
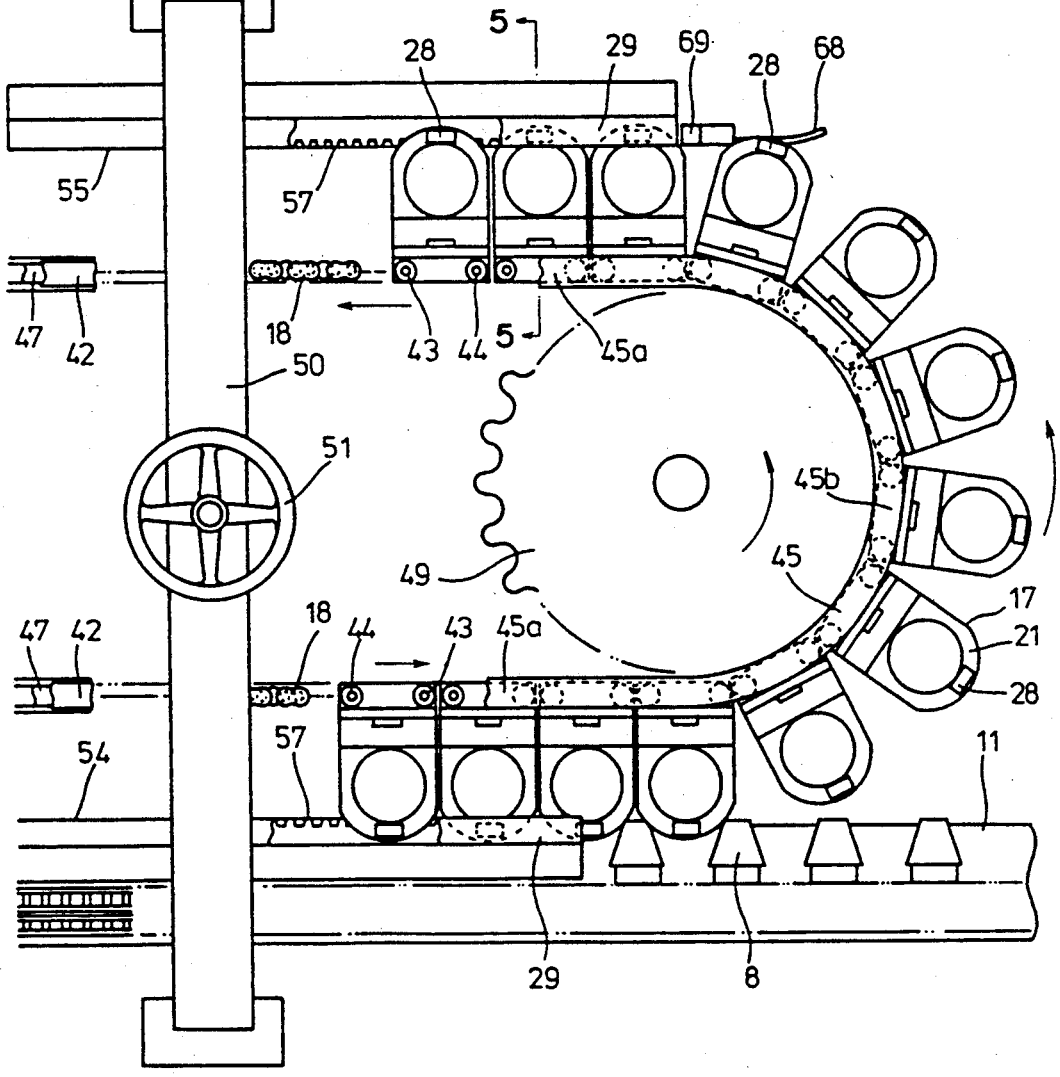

More specifically, as shown in FIG. 1, the first can feed means 1 extends linearly from a discharge area of the filling apparatus A to a region where the first can feed means 1 lies parallel to the second can feed means 2. As illustrated in FIGS. 2 and 3, the first can feed means 1 has a rotatable endless chain 7 and a plurality of fingers 8 mounted at equally spaced intervals on the endless chain 7 for gripping the barrels of cans X at front and rear sides thereof with respect to the direction of feed along the first can feed means 1. The fingers 8 are vertically swingable for gripping and releasing the cans X.

Figure 4:
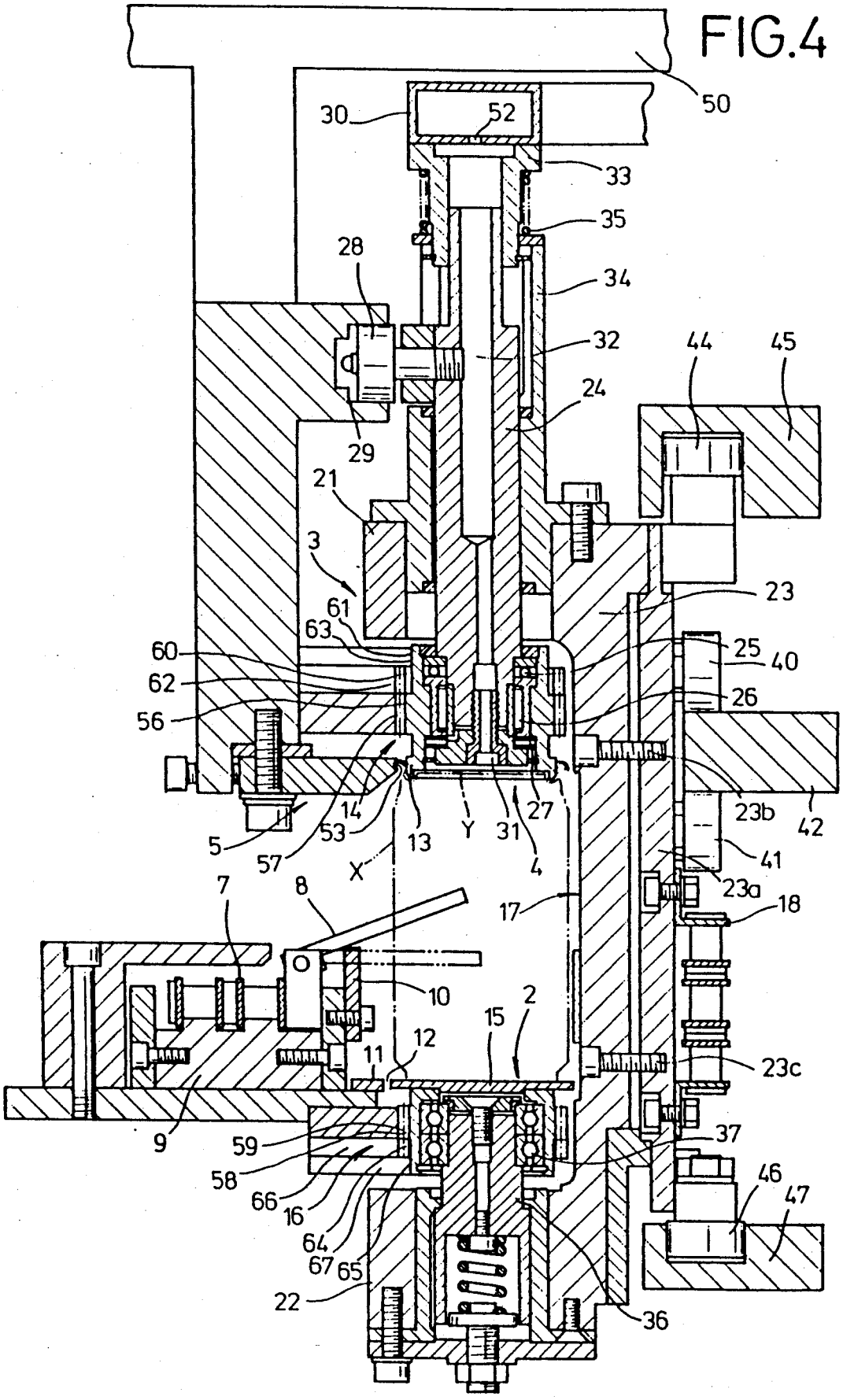
FIG. 4 is a cross-sectional view taken along line 4—4 of FIG. 2.

As shown in FIG. 4, the endless chain 7 is slidably guided on a guide rail 9. As described later on, when can ends Y are clinched on cans X, the fingers 8 are held against a rail 10 and moved upwardly to disengage from the cans X.

The first can feed means 1 has a support plate 11 extending along the endless chain 7 for horizontally supporting cans X. When the endless chain 7 is actuated by a drive unit (not shown), the fingers 8 mounted on the endless chain 7 move cans X slidably on and along the support plate 11 while gripping the cans X. The support plate 11 is cut out or recessed at 12 in its region parallel to the first seaming means 5. In this region, the cans X are supported and fed by the second can feed means 2.

As shown in FIG. 4, the can end holder means 4 which is rotatable and vertically movable has seaming chucks 13 for holding respective can ends Y. A rotative drive means 14 is disposed along the outer periphery of the can end holder means 4 for rotating each of can ends Y.

The second can feed means 2 has support tables 15 for horizontally placing cans X respectively thereon and supporting them rotatably. A rotative drive means 16 which is of the same structure as the rotative drive means 14 is disposed along the outer periphery of each support table 15.

The can end feed means 3 which is positioned above the second can feed means 2 in confronting relation thereto is integrally joined to the second can feed means 2 through feed blocks 17 (described later).

The feed blocks 17 are coupled to an elliptical endless chain 18 at spaced intervals and hence are movable along an elliptical path by the endless chain 18 (see also FIGS. 2 and 3). The feed blocks 17 are moved in the same direction and at the same speed as the first can feed means 1 in the region where the feed blocks 17 are arrayed parallel to the first can feed means 1. In the region parallel to the first can feed means 1, the feed blocks 17 are successively moved along an arcuate path progressively closer tangentially to the first can feed means 1 and then travel parallel to the first can feed means 1, after which the feed blocks 17 are moved along an arcuate path progressively away from the first can feed means 1. The feed blocks 17 run parallel to the first can feed means 1 along the recess 12 of the support plate 11.

As illustrated in FIGS. 1 and 2, can ends Y are supplied to the can end feed means 3 by a can end supply turret 19, and can ends Y are supplied to the can end supply turret 19 by a can end supply device 20.

As shown in FIG. 4, each of the feed blocks 17 has a support portion 23 of a substantially C shape as viewed in side elevation, the support portion 23 having an upper horizontal portion 21 and a lower horizontal portion 22 integrally therewith. The support portion 23 is detachably coupled by bolts **23*b*, 23*c* to a support plate 23*a* fixed to the endless chain 18**.

The can end holder means 4 is supported by the upper horizontal portion 21 of each feed block 17. The can end holder means 4 is rotatably mounted by bearings 25, 26, 27 on the lower end of each support shaft 24 extending vertically through the upper horizontal portion 21. A cam roller 28 rotatably mounted on an upper side portion of the support shaft 24 is vertically movable by being guided by a cam rail 29 to lift and lower the can end holder means 4 supported by the upper horizontal portion 21. Each of the seaming chucks 13 of the can end holder means 4 has a suction means on its lower end for attracting a can end Y. The suction means applies attractive forces from a suction device (not shown) to the can end holder means 4 through a suction duct 30 (described later) on the upper end of the can end feed means 3. An air socket 33 communicating via a passage 32 defined in the support shaft 24 with a central opening 31 in the can end holder means 4 is slidably held against the suction duct 30 in communication therewith.

The air socket 33 is vertically movably mounted on a support rod 34 on an upper portion of the support shaft 24. The air socket 33 is normally biased against the suction duct 30 by a spring 35 disposed around the support rod 34.

The support table 15 of the second can feed means 2 for supporting cans X is disposed on the lower horizontal portion 22 of the support portion 23. The support table 15 is rotatably mounted by a bearing 37 on a support shaft 36 supported by the lower horizontal portion 22 in coaxial alignment with the support shaft 24 of the can end holder means 4 on the upper horizontal portion 21.

Each of the feed blocks 17 is supported on a rail plate 42 by means of guide rollers 38, 39, 40, 41 mounted in vertically confronting relationship on a substantially central area of the back of the support portion 23. Each feed block 17 is supported by a rail 45 having a guide groove receiving guide rollers 43, 44 supported on a pair of support shafts of different heights which are mounted on an upper back of the upper horizontal portion 21 and also by a rail 47 having a guide groove receiving a guide roller 46 mounted on the lower horizontal portion 22.

Figure 6:
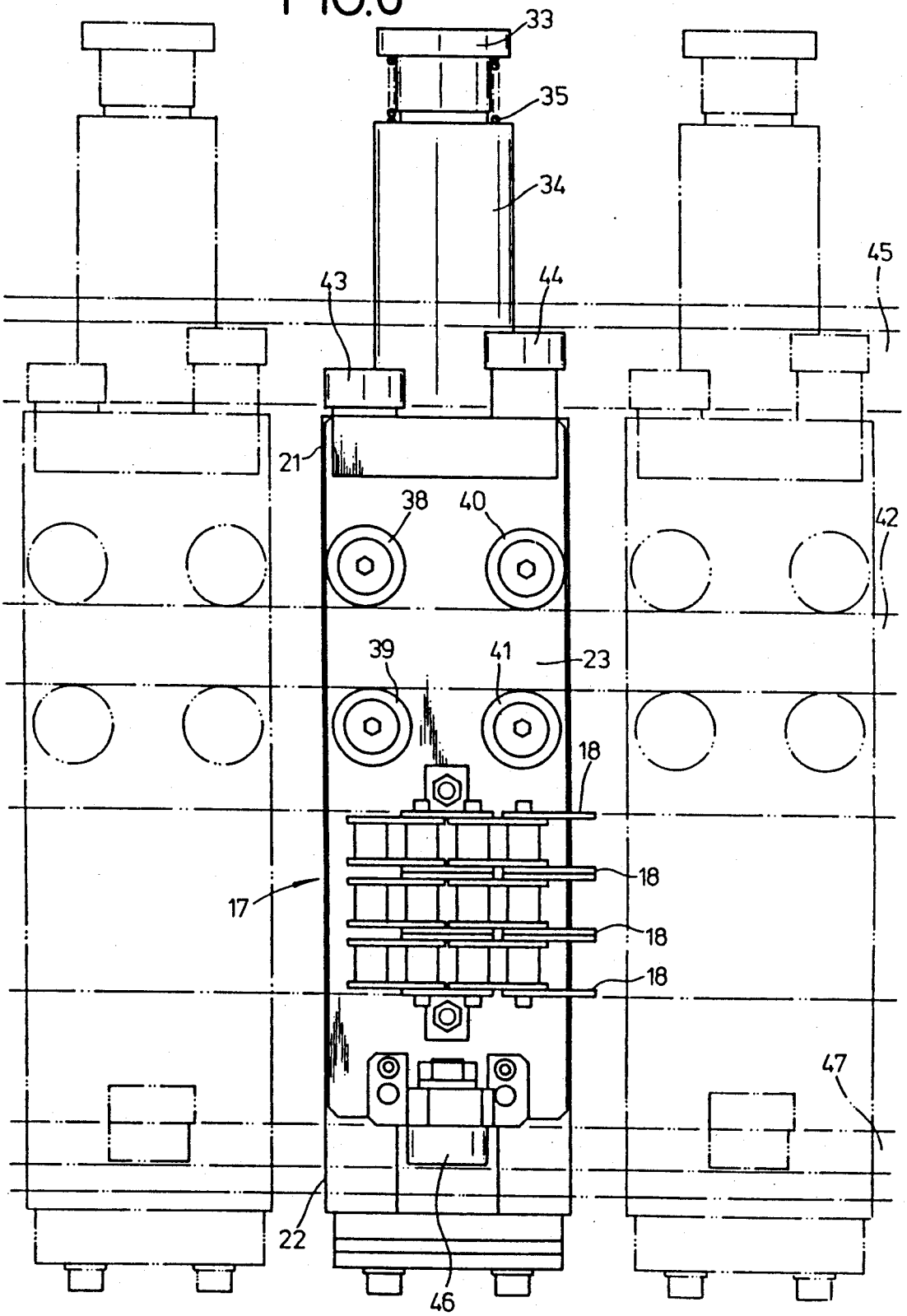
FIG. 6 is an enlarged rear elevational view of a portion of FIG. 3.

As shown in FIGS. 4 and 6, the lower backs of the support portions 23 of the respective feed blocks 17 are interconnected by the endless chain 18, which is actuated by a drive unit (not shown) through sprockets 48, 49 shown in FIGS. 2 and 3.

As illustrated in FIGS. 2 through 6, the feed blocks 17 are guided along the rail plates 42 that are endlessly joined to each other and also along the rails 45, 47 which are similarly endless. The rail plates 42 guide the feed blocks 17 to move in their forward travel along an arcuate path progressively tangentially toward the first can feed means 1, then to run parallel to the straight first can feed means 1 along the recess 12 of the support plate 11, thereafter guide the feed blocks 17 along an arcuate path progressively away from the first can feed means 1, after which the rail plates 42 guide the feed blocks 17 in their return travel along a straight path and then along an arcuate path toward the forward travel path.

Figure 8:
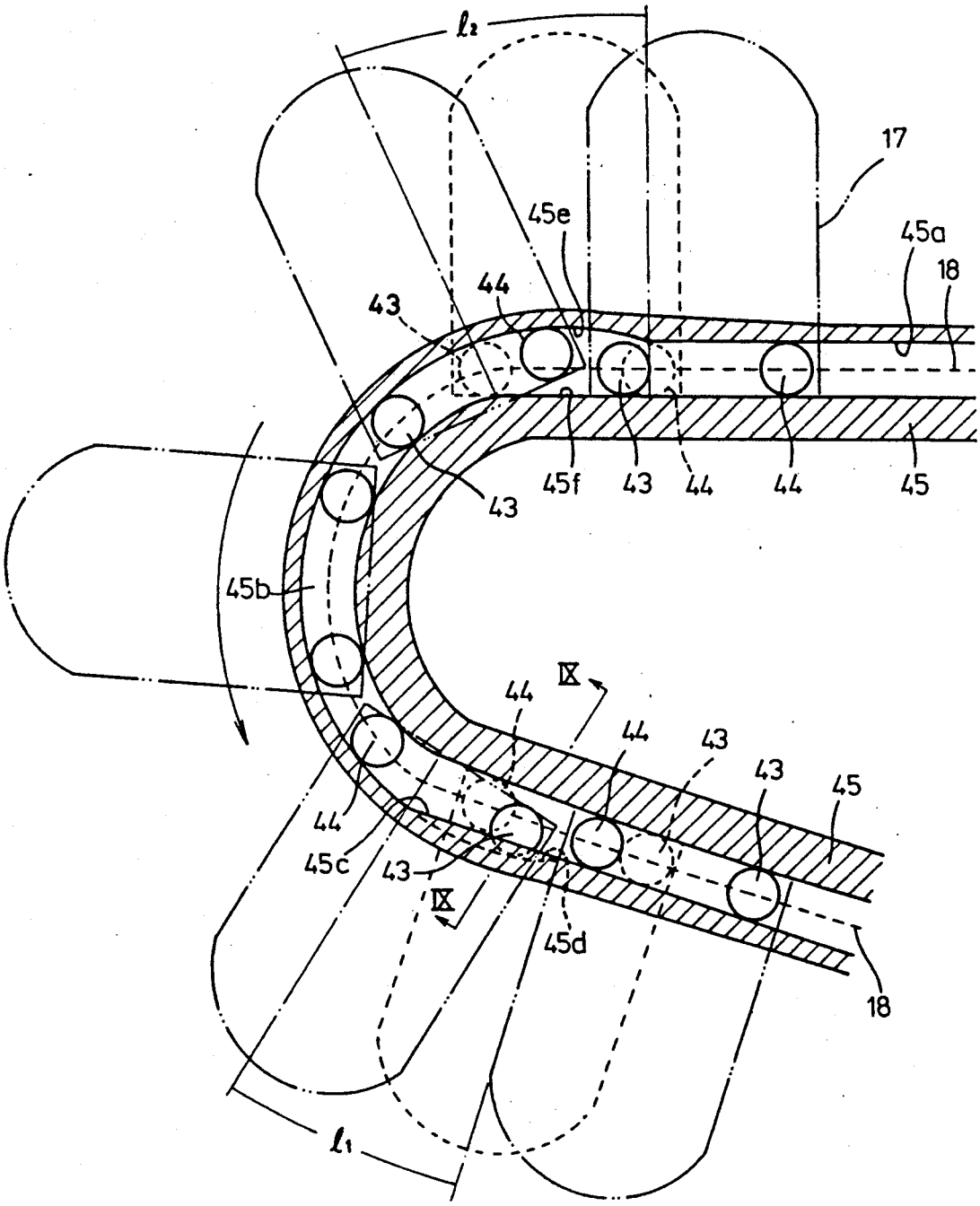
FIG. 8 is an enlarged cross-sectional view of a portion of FIG. 3.
Figure 9:
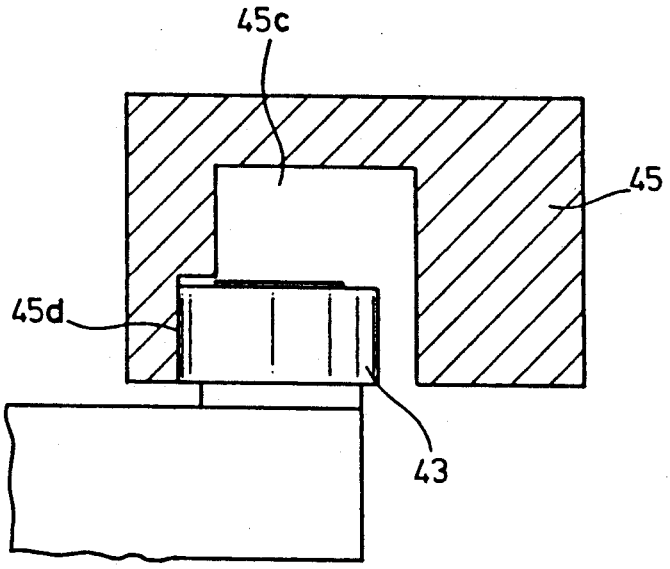
FIGS. 9 and 10 are cross-sectional views taken along line IX—IX of FIG. 8.
Figure 10:
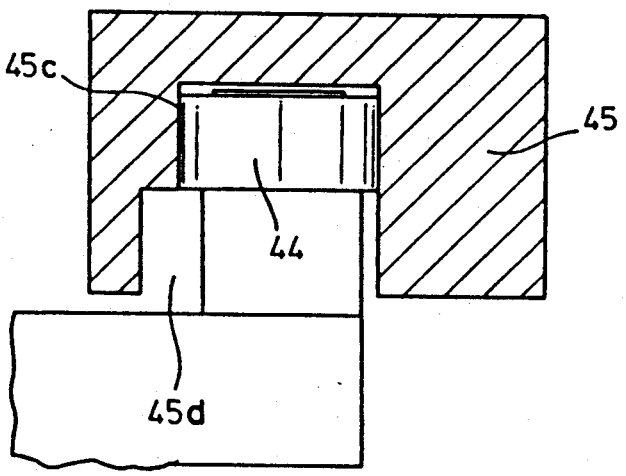

When the rollers 43, 44 are positioned on a straight track **45*a* and an arcuate track 45*b* which are aligned with the track of the endless chain 18, the rail 45 guides the rollers 43, 44 along one track while transversely restricting them. As shown in FIGS. 8 and 9, in a transition area $l_1$ where the feed blocks 17 move from the arcuate track 45*b* from the straight track 45*a*, the guide groove in the rail 45 has a straight track 45*c* in its upper portion near the bottom of the guide groove, and a curved track 45*d* in its lower portion near the opening of the guide groove, the curved track 45*d* extending outwardly of the straight track 45*c*. The leading roller 43 of each feed block 17 travels along the lower track 45*d* as shown in FIGS. 8 and 9, whereas the trailing roller 44 moves along the upper track 45*d* as indicated by the imaginary line in FIG. 8 and as shown in FIG. 10**.

As shown in FIG. 8, in a transition area $l_2$ where the feed blocks 17 move from the straight track **45*a* to the arcuate track 45*b* the guide groove in the rail 45 has a curved track 45*e* extending outwardly of the arcuate track 45*b*. When the rollers 43, 44 move through the transition area $l_2$, the leading roller 43 runs along a track 45*f* which is an extension of the straight track 45*a*, whereas the trailing roller 44 moves along the curved track 45*e***.

Therefore, in the transition area from the straight track **45*a* to the arcuate track 45*b* and the transition area from the arcuate track 45*b* to the straight track 45*a*, each of the feed blocks 17 can smoothly be moved while being guided by the rail 45**.

As shown in FIGS. 2 through 5, the cam rails 29 are integrally mounted on the first seaming means 5 and the second seaming means 6 parallel thereto at positions where the cam rollers 28 of the feed blocks 17 are moved. The cam rails 29 serve to guide the cam rollers 28 in the direction in which the feed blocks 17 are fed, and also to guide vertical movement of the seaming chucks 13 through the support shafts 24. As illustrated in FIGS. 2 and 3, the cam rails 29 are supported by a beam 50 extending therebetween and can be vertically moved together by a handle 51 mounted on a screw rod threaded through the beam 50.

When can ends Y are to be seamed to cans X of a different height, the feed blocks 17 are detached from the endless chain 18, and other feed blocks 17 with the distance between the can end holder means 4 and the support table 15 matching the height of the new cans X are mounted on the endless chain 18. Then, the handle 51 is turned to vertically move the beam 50 to bring the cam rails 29 and the seaming means 5, 6 into a new seaming position.

Figure 7:
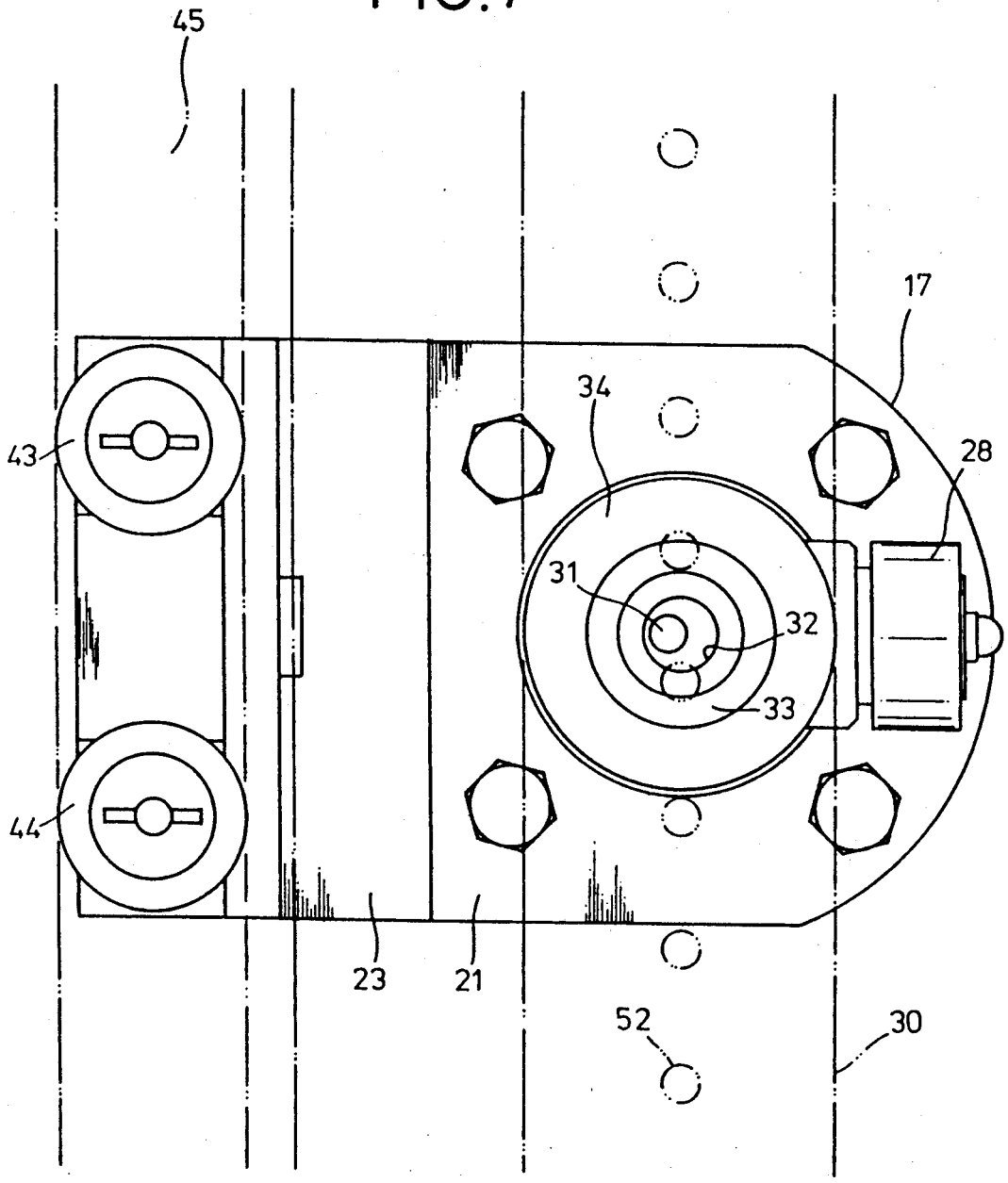
FIG. 7 is an enlarged plan view of a portion of FIG. 3.

As illustrated in FIG. 2, the suction duct 30 is positioned over and along the path of movement of the air sockets 33 of the respective feed blocks 17. As shown in FIG. 7, the suction duct 30 has a number of circular holes 52 defined in the lower plate thereof at spaced intervals for communication with the air sockets 33.

As shown in FIG. 2, the first seaming means 5 is linearly disposed in the region where the feed blocks 17 run along the rail plates 42 parallel to the recess 12 in the support plate 11. As illustrated in FIGS. 2 through 4, the first seaming means 5 has a first crimping groove 53 and a second crimping groove 54 which are joined lineary to each other for seaming the end hook of a can end Y to the flange of a can X, the first and second crimping grooves 53, 54 being positioned along the forward travel path along which cans X are linearly fed by the second can feed means 2.

Figure 5:
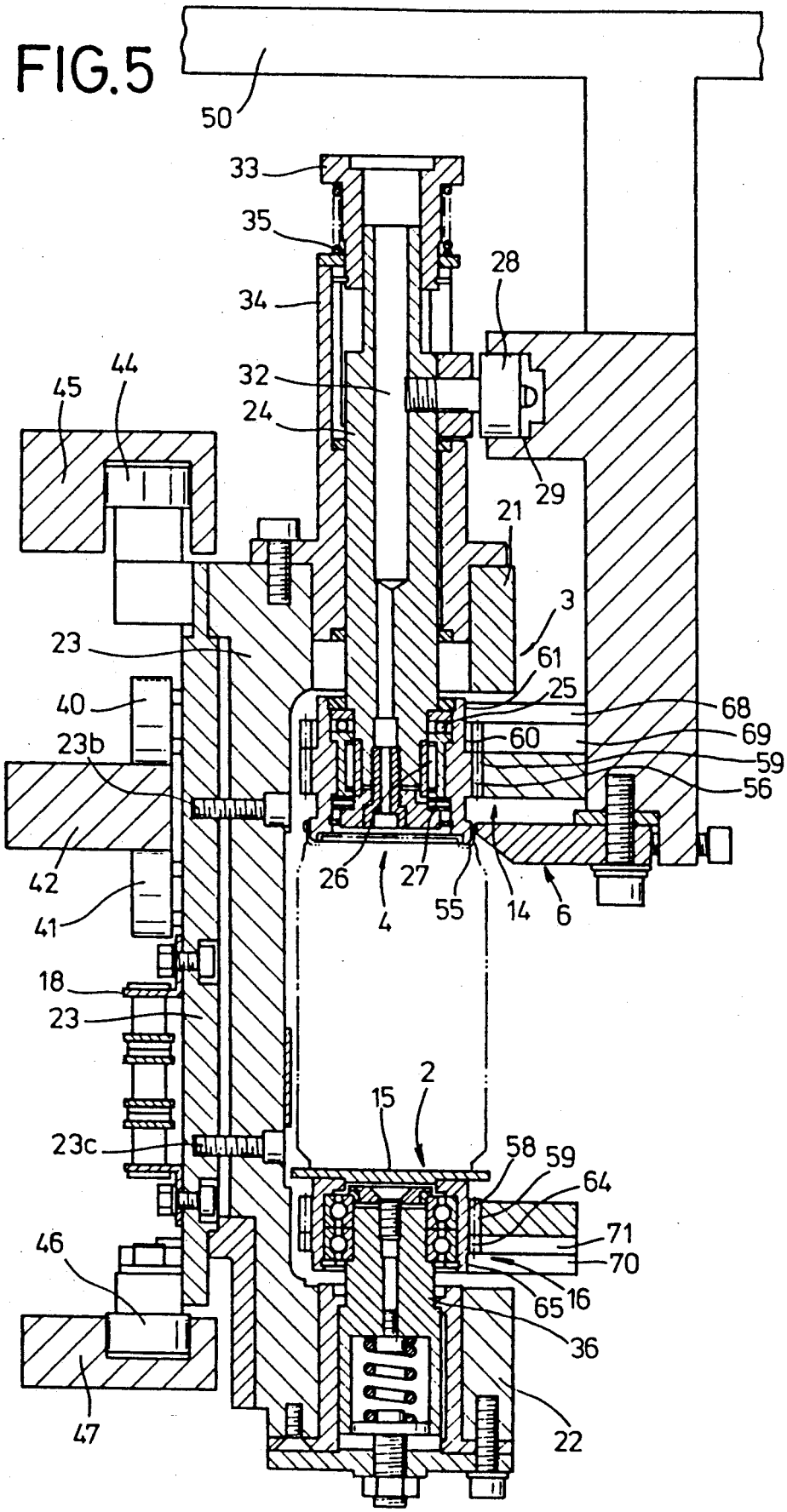
FIG. 5 is a cross-sectional view taken along line 5—5 of FIG. 3.

As shown in FIG. 5, the second seaming means 5 has a third crimping groove 55 extending linearly along the return travel path along which cans X are linearly fed by the second can feed means 2.

As shown in FIG. 4, the rotative drive means 14, 16 serve to roll the flange of a can X and the end hook of a can end Y while pressing them against the first and second seaming means 5, 6 when the can X and the can end Y are gripped by each seaming chuck 13 of the can end holder means 4 and each support table 15 of the second can feed means 2.

The rotative drive means 14 comprises a first pinion gear 56 disposed fully around the upper outer periphery of the seaming chuck 13, and a first linear rack 57 extending along the first and second seaming means 5, 6 for mesh with the first pinion gear 56.

The rotative drive means 16 comprises a second pinion gear 58 disposed coaxially with the support shaft 36 of the support table 15, and a second linear rack 59 extending along the first and second seaming means 5, 6 for mesh with the second pinion gear 58.

When each of the feed blocks 17 move along the first and second seaming means 5, 6, the first and second pinion gears 56, 58 are rotated by mesh with the first and second racks 57, 59, respectively, to rotate the seaming chuck 13 and the support table 15, as shown in FIG. 4. Upon rotation of the seaming chuck 13 and the support table 15, the can end Y and the can X which are gripped between the seaming chuck 13 and the support table 15 are also rotated.

Figure 11:
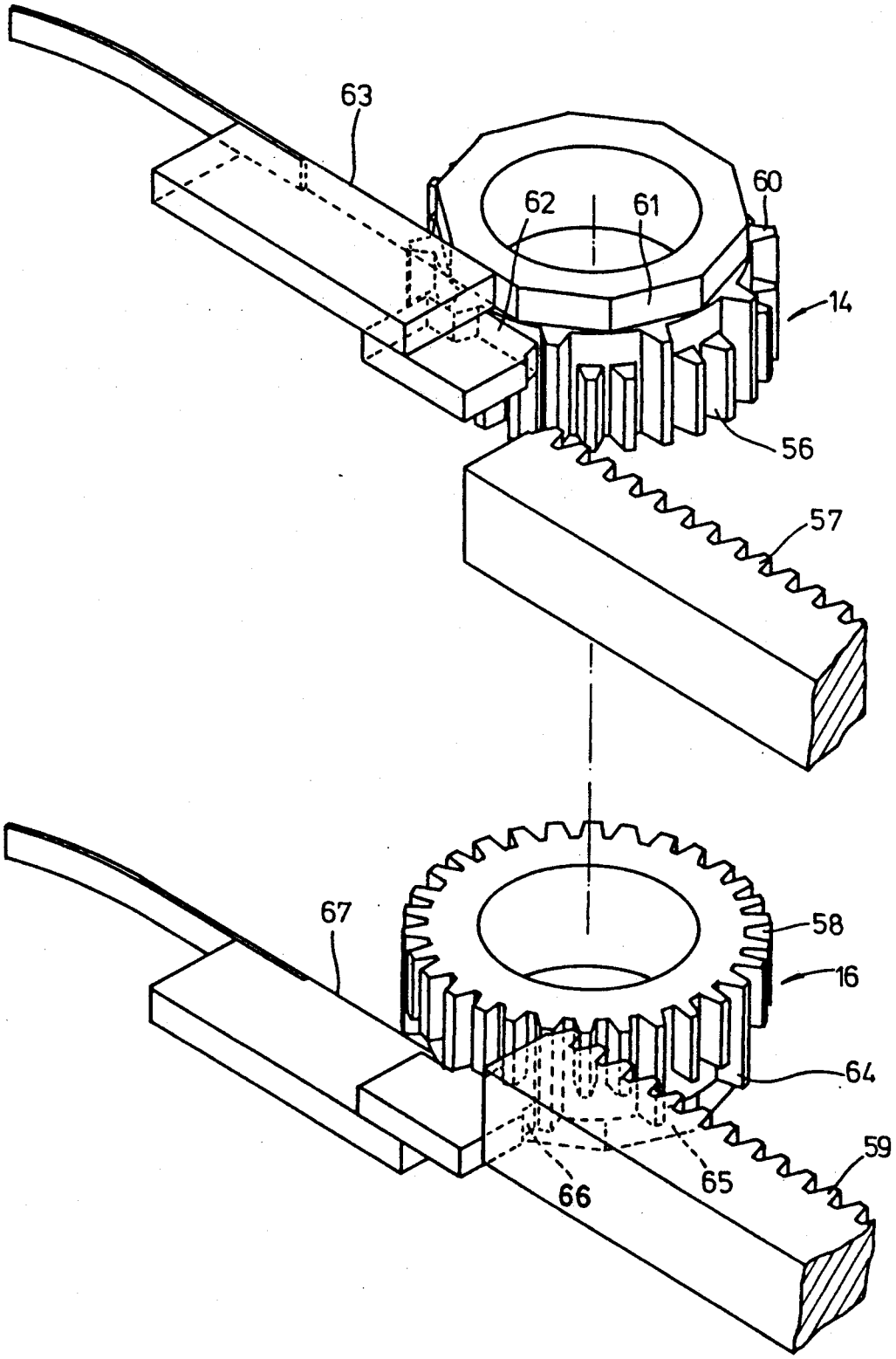
FIGS. 11 and 12 are views showing operation of rotative drive means.
Figure 12:
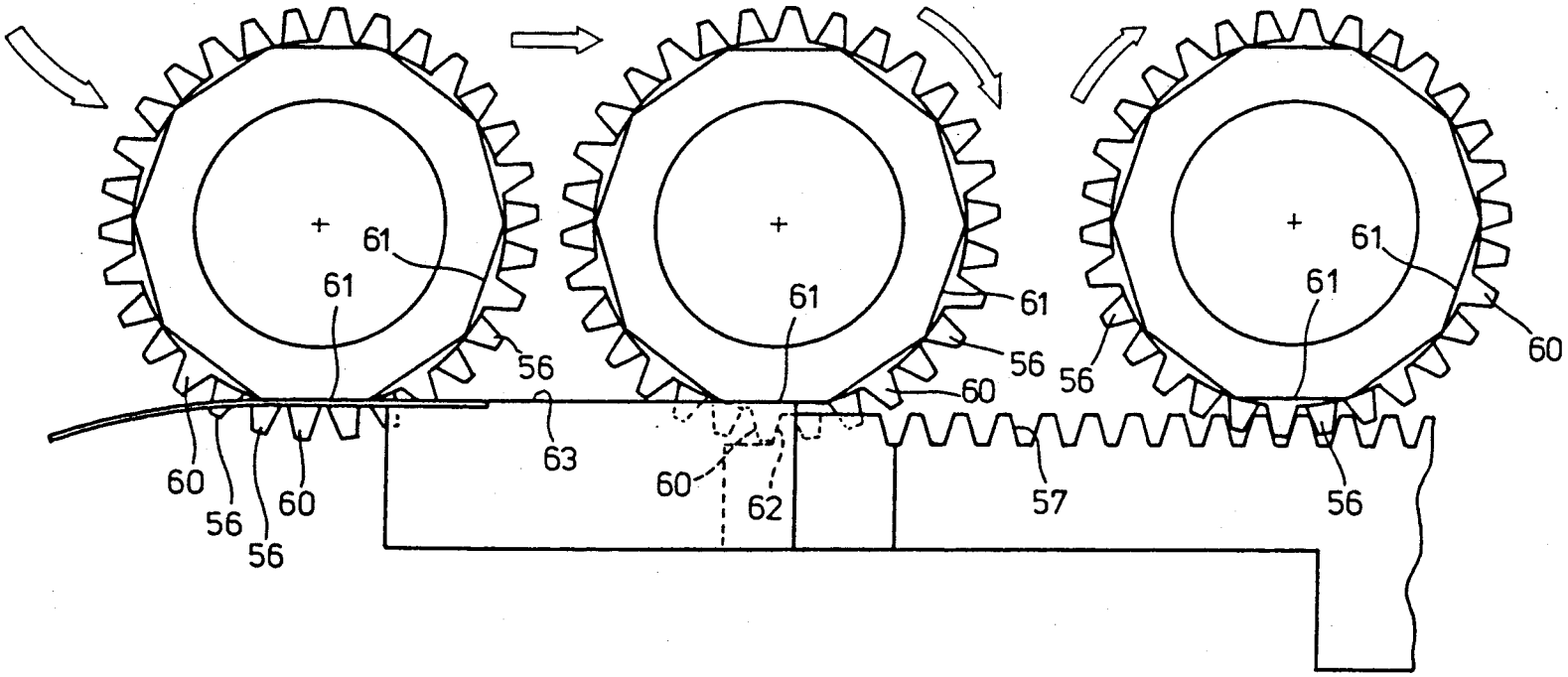

As shown in FIGS. 11 and 12, the rotative drive means 14 comprises a plurality of first teeth 60 equally spaced circumferentially and projecting radially outwardly from a tubular body coaxially rotatable with the first pinion gear 56, and a plurality of slidable flat surfaces 61 disposed above and rotatable with the first teeth 60.

A first rail 63 is positioned in a region where the first slidable flat surfaces 61 pass, and extends horizontally from an end of the first rack 57 upstream thereof in the direction in which cans X and can ends Y are fed. One at a time of the first slidable flat surfaces 61 is turned into a position along the first rail 63 upon engagement with the first rail 63. In response to such turning movement of the first slidable flat surface 61, the first pinion gears 56 are positioned for smooth mesh with the first rack 57.

The first teeth 60 are located downwardly of the centers of the respective first slidable flat surfaces 61, the first teeth 60 being integral with the teeth of the first pinion gear 56.

A first engagement member 62 is disposed in a region where the first teeth 60 pass and between the first rack 57 and the first rail 63 for engaging the first teeth 60.

As described above, when one of the first slidable flat surfaces 61 is engaged and turned by the first rail 63, the first pinion gear 56 is positioned for mesh with the first rack 57. Thereafter, one of the first teeth 60 engages the first engagement member 62. As the first tooth 60 moves in the feeding direction, the engagement between the first engagement member 62 and the first tooth 60 causes the first pinion gear 56 to rotate on and start meshing with the first rack 57.

The rotative drive means 16 is of the same structure as the rotative drive means 14 as shown in FIGS. 4, 5, and 11. More specifically, the rotative drive means 16 comprises a plurality of second teeth 64 equally spaced circumferentially and projecting radially outwardly from a tubular body coaxially rotatable with the second pinion gear 58, and a plurality of slidable flat surfaces 65 disposed above and rotatable with the second teeth 64. The rotative drive means 16 also includes a second engagement member 66 and a second rail 67.

The same structures as the first rail 63 and the first engagement member 62 and the second rail 67 and the second engagement member 66 for guiding the first and second gears 56, 58 into mesh with the first and second racks 57, 59 are disposed upstream of ends of second racks 59 of the second seaming means 6 in the feeding direction, as shown in FIGS. 3 and 5. Denoted at 68 is a third rail engageable by the first slidable flat surfaces 61, 69 a third engagement member engageable by the first teeth 60, 70 a fourth rail engageable by the second slidable flat surfaces 65, and 71 a fourth engagement member engageable by the second teeth 64.

The seaming apparatus B thus constructed will operate as follows:

Cans X are filled with contents by the filling apparatus A, and then each gripped between two fingers 8 of the first can feed means 1 and linearly fed on the support plate 11.

Can ends or covers Y are supplied from the can end supply device 20, and then fed from the can end supply turret 19 to the can end feed means 3 of the respective feed blocks 17. In the position where a supplied can end Y is transferred to the can feed means 3, the opening 31 of the can end feed means 4 is connected to the suction duct 30 through the passage 32 and the suction socket 33, as shown in FIG. 4. Therefore, the can end Y is attracted to the can end holder means 4 under a vacuum developed in the opening 31.

Each feed block 17 with the can end Y held on the can end holder means 4 is turned by the endless chain 18 which travels along the substantially elliptical path so as to move from the straight track **45*a* into the arcuate track 45*b*. At this time, as shown in FIG. 8, the guide roller 43 on the feed block 17 moves along the inner straight track 45*f* at the inlet of the arcuate track 45*b***.

Then, the guide roller 44 enters the track 45*e* extending outwardly of the straight track 45*a*. Thereafter, the guide rollers 43, 44 roll on along the arcuate track 45*b* and then into straight track 45*a* along which the feed block 17 will move along the forward travel path. At the inlet of the straight track 45*a*, the rail 45 has the outwardly extending track 45*d* in its lower portion and the straight track 45*c* in its upper portion which is identical to the track of the endless chain 18, as shown in FIGS. 8 and 9. Thus, the guide roller 43 moves along the lower track 45*d* in the rail 45. At the same time that the guide roller 43 starts moving linearly, the guide roller 44 moves linearly along the upper track 45*c* in the rail 45. Therefore, when the feed block 17 goes from the straight track 45*a* to the arcuate track 45*b* or from the arcuate track 45*b* to the straight track 45*a*, it is smoothly turned while being guided by the rail 45.

As shown in FIGS. 2, 4, and 6, the feed blocks 17 are guided by the guide rollers 38, 49, 40, 41, 43, 44 along the rail plates 42 and the rails 45, 47, and moved by the endless chain 18 progressively closer to the first can feed means 1 and then into a position parallel to the first can feed means 1. Each can X fed by the first can feed means 1 is transferred onto one of the support tables 15 of the second can feed means 2 at the recess 12 of the support plate 11 while being gripped by a pair of fingers 8. The can X as it is gripped by the fingers 8 is placed on the support table 15. Even if the first and second can feed means 1, 2 run at different speeds, the can X is accurately placed centrally on the support table 15 by the fingers 8. When the can X has been transferred to the second can feed means 2, the fingers 8 are engaged and moved upwardly by the rail 10, thus releasing the can X.

When the can X is thus transferred to the second can feed means 2, one of the first slidable flat surfaces 61 of the can end holder means 4 engages the first rail 63 and is turned thereby into the position parallel to the first rail 63, whereupon the first pinion 56 is positioned for mesh with the first rack 57. Thereafter, one of the first teeth 60 engages the engagement member 62. Upon further angular movement of the first tooth 60 out of engagement with the engagement member 62, the first pinion gear 56 is rotated into smooth mesh with the first rack 57. Likewise, one of the second slidable flat surfaces 65 coupled to the support tables 15 engages the second rail 67 to position the second pinion 58 for mesh with the second rack 59. One of the second teeth 64 then engages the second engagement member 66 and further turns out of engagement therewith to rotate the second pinion gear 58 smoothly into mesh with the second rack 59.

During this time, the can end holder means 4 is lowered by the can rail 29 through the cam roller 28. The first pinion gear 56 is also lowered while being kept in mesh with the first rack 57. The can end Y held by the can end holder means 4 is placed on and pressed against the can X on the support table 15.

Figure 13:
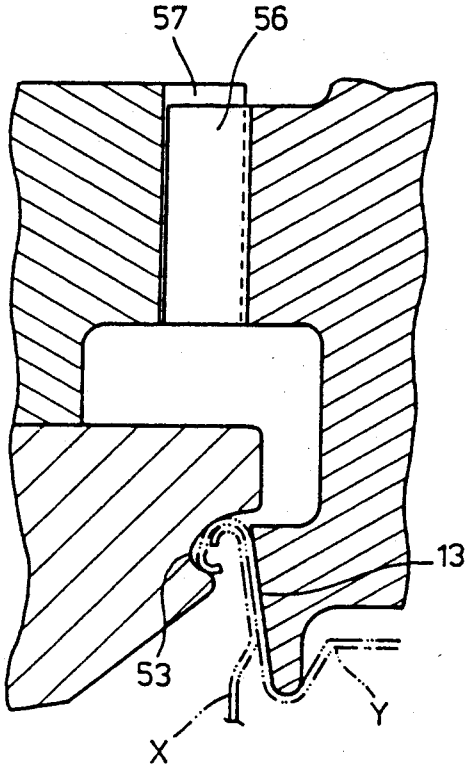

As the feed block 17 is turned while feeding the can end Y and the can X, the seaming chuck 13 of the can end holder means 4 and the support table 15 of the second can feed means 2 are rotated in synchronism with the feed of the can end Y and the can X, thus rotating the can end Y and the can X. In the forward travel path of the second can feed means 2, the support table 15 linearly feeds the can end Y and the can X while rotating them. Simultaneously, as shown in FIG. 13, the end hook of the can end Y is pressed into the first crimping groove 53 of the first seaming means 5 and rolled and clinched on the flange of the can X. Then, the end hook of the can end Y is further pressed into the second adjoining crimping groove 54 of the first seaming means 5 and clinched on the flange of the can X.

Figure 15:
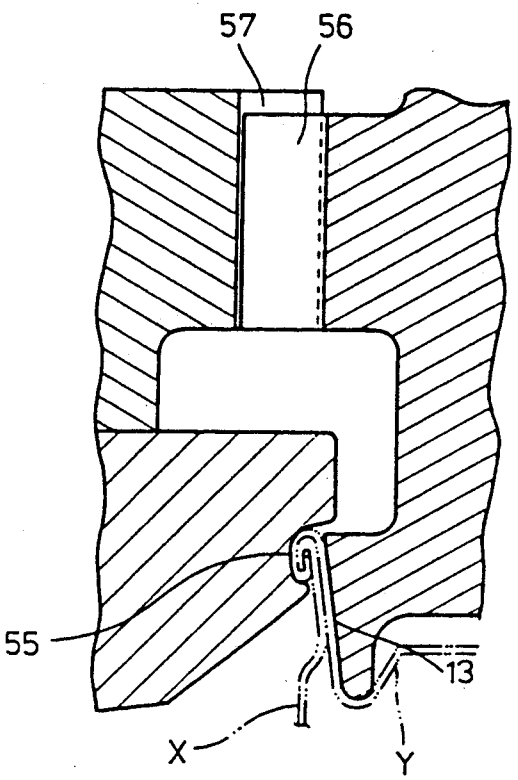
FIGS. 13 through 15 are fragmentary cross-sectional views showing operation of seaming means.
Figure 14:
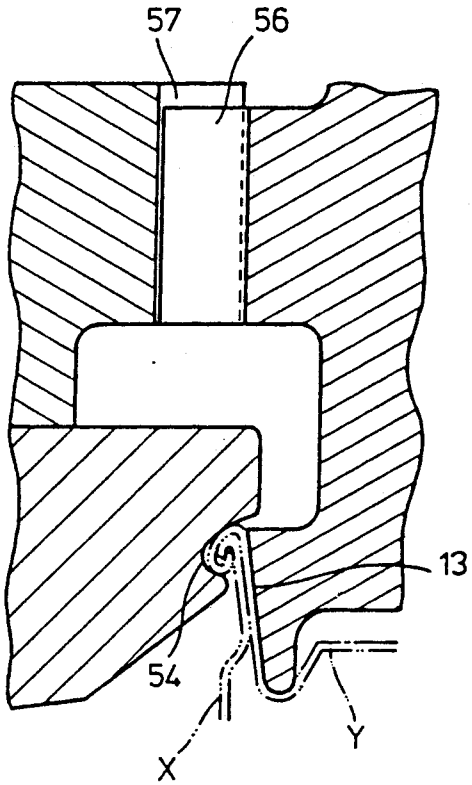

Thereafter, when the feed block 17 is moved away from the first can feed means 1, the can X with the can end Y seamed thereto is fed by the second can feed means 2. While being gripped by the can end holder means 4 and the support table 15, the can X and the can end Y are linearly fed, and at the same time the flange and the end hook are pressed into the third groove 55 of the second seaming means 6 and clinched together. The can X and the can end Y are finally double-seamed as shown in FIG. 15.

The can X which has been closed by the seamed can end Y is then discharged from an outlet path 73 by means of a discharge turret 72 (FIG. 1).

Rotative drive means according to other embodiments for rotating cans and can ends will be described below.

Figure 16:
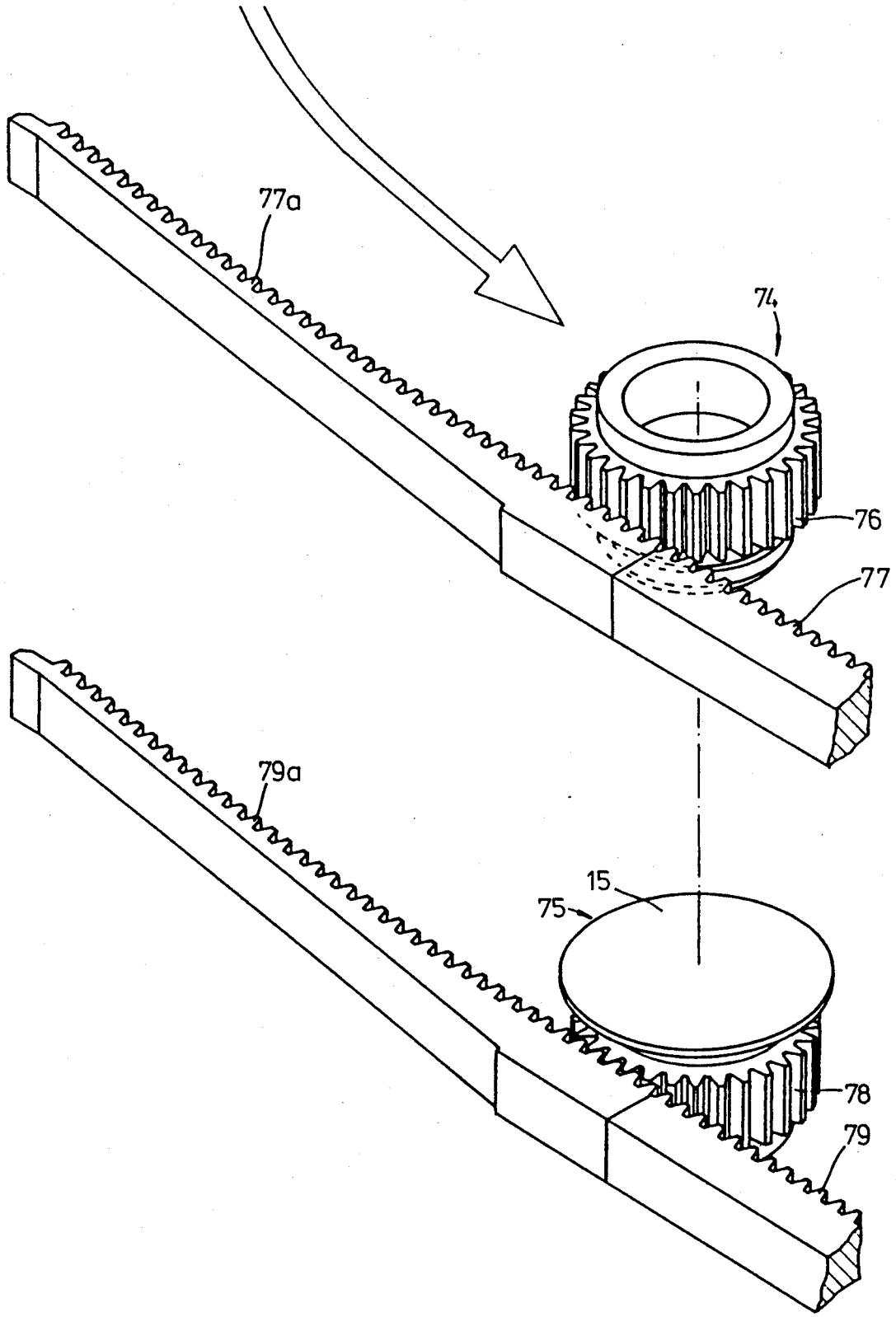
FIGS. 16 and 17 are perspective views showing other rotative drive means.

FIG. 16 shows the manner in which first and second rotative drive means 74, 75 according to another embodiment are operated. The first rotative drive means 74 which is associated with the can end holder means 4 comprises a first pinion gear 76 disposed fully around the outer periphery of each of the seaming chucks 13, and a first linear rack 77 extending along the first and second seaming means 5, 6 for mesh with the first pinion gear 76. The first rack 77 has a swingable portion 77*a* made of an elastic material such as soft synthetic resin, for example, and elastically swingable horizontally, the swingable portion 77*a* being positioned in an area where the first pinion gear 76 starts to mesh with the rack 77. The swingable portion 77*a* has a free upstream end in the feeding direction.

The second rotative drive means 75 which is associated with each support table 15, i.e., the second can feed means 2, comprises a second pinion gear 78 disposed fully around the lower outer periphery of each of the support tables 15, and a second linear rack 79 extending along the first and second seaming means 5, 6 for mesh with the second pinion gear 78. The second rack 79 has a swingable portion 79*a* made of an elastic material such as soft synthetic resin, for example, and elastically swingable horizontally, the swingable portion 79*a* being positioned in an area where the second pinion gear 78 starts to mesh with the rack 79. The swingable portion 79*a* has a free upstream end in the feeding direction.

When the pinion gears 76, 78 are not angularly positioned for smooth mesh with the respective racks 77, 79 at the time they should be brought in mesh with each other, the swingable portions 77*a*, 79*a* are elastically swung horizontally backwards away from the pinion gears 76, 78. When the pinion gears 76, 78 are then angularly positioned for mesh with the respective racks 77, 79, the swingable portions 77*a*, 79*a* spring back to allow the pinion gears 76, 78 to mesh smoothly with the racks 77, 79.

Figure 17:
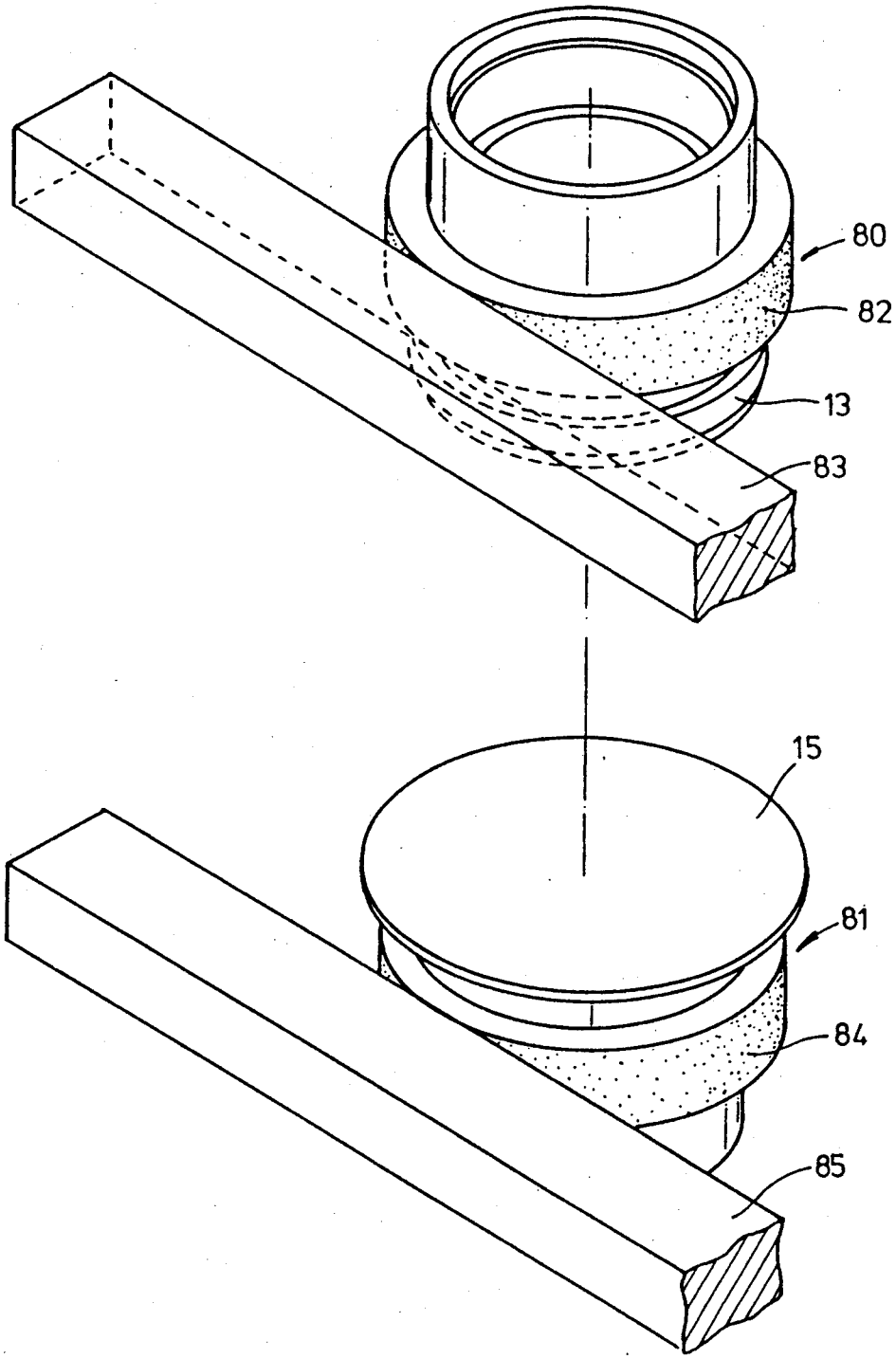

FIG. 17 illustrates first and second frictionally rotatable rotative drive means 80, 81 according to still another embodiment of the present invention, the first and second rotative drive means 80, 81 being associated respectively with the can end holder means 4 and the second can feed means 2. The first rotative drive means 80 comprises a first roll 82 coaxial and rotatable with each of the seaming chucks 13 and having a high coefficient of friction, and a first rail 83 of a high coefficient of friction extending along the first and second seaming means 5, 6 for frictionally engaging the first roll 82. The first roll 82 and the first rail 83 have respective layers of polyurethane resin for frictionally engaging each other. The first roll 82 and the second rail 83 are pressed against each other progressively more strongly from their upstream sides when they are to be frictionally engaged. The second rotative drive means 81 also comprises a second roll 84 coaxial and rotatable with each of the support tables 15 and having a high coefficient of friction, and a second rail 85 of a high coefficient of friction extending along the first and second seaming means 5, 6 for frictionally engaging the second roll 84. The second roll 84 and the second rail 85 are of the same structure as the first roll 82 and the first rail 83.

The rolls 82, 84 of the first and second rotative drive means 80, 81 frictionally engage rails 83, 85, respectively, and are rotated frictionally through engagement therewith. Since the rolls 82, 84 and the rails 83, 85 frictionally engage each other, they do not suffer from a timing error or meshing failure which would otherwise be caused by pinions and racks.

In the above embodiments, a can end Y and a can X are rotated in unison with each other by the first and second rotative drive means. However, a means for rotating at least the can end holder means only may be employed to press the end hook of a can end Y and the flange of a can X against the seaming means without slippage and to clinch them.

Figure 18:
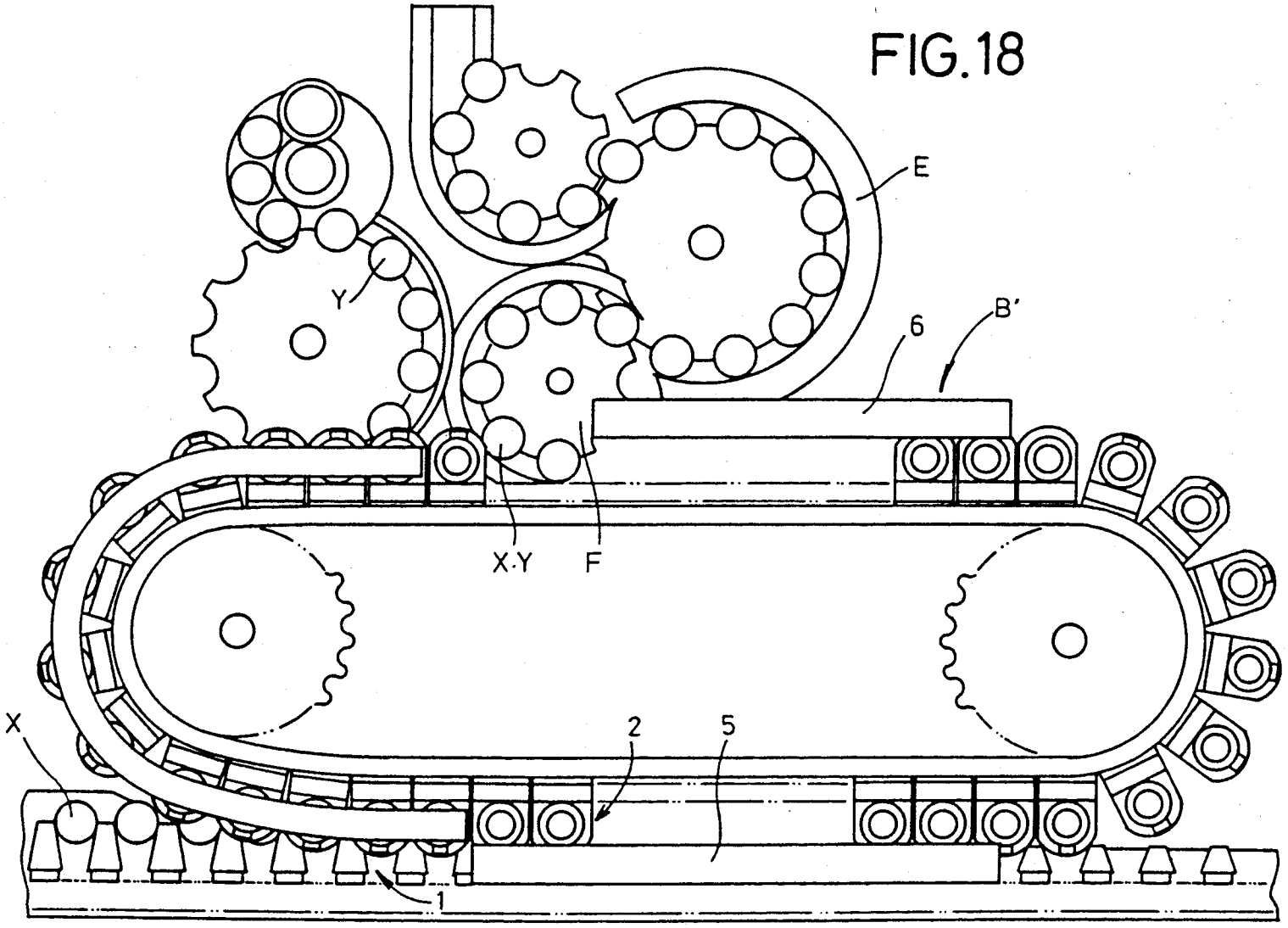
FIG. 18 is a schematic plan view of a seaming apparatus according to another embodiment of the present invention.

FIG. 18 shows a seaming apparatus B' in accordance with a further embodiment of the present invention. The seaming apparatus B' is of basically the same construction as the seaming apparatus B except that a second seaming device E is provided in addition to the seaming means 5, 6.

Those parts shown in FIG. 18 which are identical to those of the seaming apparatus B are denoted by identical reference numerals, and will not be described in detail.

The seaming apparatus B' is suitable for use with cans X having a lower buckling strength. The seaming apparatus B' double-seams can ends Y to cans X with the first seaming means 5, the second seaming means 6, and the additional second seaming device E.

The second seaming device E is of the same structure as a conventional seaming device. The second seaming device E is connected to a transfer unit F for receiving cans X with can ends Y seamed thereto from the seaming apparatus B' and transferring the cans X to the second seaming device E. Therefore, the second seaming device E receives the cans X with the seamed can ends Y from the seaming apparatus B' through the transfer unit F.

In the seaming apparatus B', a can end Y is progressively clinched to a can X by the first seaming means 5 along the forward travel path of the can end feed means 2 and the second can feed means 3, and then the can end Y is further clinched to the can X by the second seaming means 3 along the return travel path of the can end feed means 2 and the second can feed means 3. The can end Y is additionally clinched to the can X by the second seaming device E. Thus, the can end Y is double-seamed to the can X.

According to the seaming apparatus B', the can end Y is clinched to the can X at three separate locations. Since the can end Y is crimped or deformed to a smaller extent per unit amount of movement with respect to the can X in each of the first and second seaming means 5, 6 and the second seaming device E, the can end Y is progressively seamed to the can X. Consequently, the can end Y can be crimped while holding the can end Y and the can X under smaller pressure, and the can end Y can be crimped with higher accuracy.

In the illustrated embodiments, the can end Y is double-seamed to the can X. However, the can end Y may be provisionally clinched by the seaming means in preparation for a double-seaming process. After the can end Y has been provisionally clinched to the can X by the seaming apparatus of the invention, since the can X is already closed by the can end Y, the can end Y may subsequently be seamed to the can X by a conventional seaming apparatus. Alternatively, the can end Y may be provisionally clinched to the can X and also clinched to the can X as a first step of the double-seaming process, by the seaming means of the present invention.

Although certain preferred embodiments have been shown and described, it should be understood that many changes and modifications may be made therein without departing from the scope of the appended claims.

What is claimed is:

1. An apparatus for seaming a can end to a filled cylindrical can, comprising:

can feed means for supporting the bottom of the can rotatably about its own axis and feeding the can linearly along a travel path at a predetermined speed;

can end holder means for detachably holding the can end directly above said can feed means and holding the can end rotatably about its own axis;

can end feed means for moving said can end holder means to feed the can end in synchronism with the can which is fed by said can feed means;

lifting/lowering means for lowering said can end holder means to hold the can end held by said can end holder means against an open end of the can;

seaming means extending linearly along said travel path for pressing an end hook of the can end and a flange of the can while the can against which the can end is held is being fed by said can feed means; and drive means for rotating said can end holder means and said can feed means to roll the can end and the can along said seaming means while the can is fed linearly along said travel path to seam the can end to the can while the end hook of the can end and the flange of the can are being pressed by said seaming means;

wherein said filled cylindrical can and said can end are rotated in synchronism against said seaming means only subsequent to said can end being held against said filled cylindrical can.

2. An apparatus according to claim 1, wherein said can end holder means and said can feed means are rotatable about an axis aligned with the axis of the can when the can end is held against the can.

3. An apparatus according to claim 1, wherein said drive means comprises rotative drive means for rotating said can end holder means in synchronism with the feeding of the can by said can feed means.

4. An apparatus according to claim 3, wherein said rotative drive means comprises a pinion gear coaxial with said axis of the can end holder means, and a rack extending along said seaming means for mesh with said pinion gear.

5. An apparatus according to claim 1, wherein said drive means comprises first rotative drive means for rotating said can end holder means and second rotative drive means for rotating said can feed means in synchronism with the rotation of said can end holder means.

6. An apparatus according to claim 5, wherein said first rotative drive means comprises a first pinion gear coaxial with said axis of the can end holder means, and a first rack extending along said seaming means for mesh with said first pinion gear, and wherein said second rotative drive means comprises a second pinion gear coaxial with said axis of the can feed means, and a second rack extending along said travel path for mesh with said second pinion gear.

7. An apparatus according to claim 4, wherein said can end holder means comprises a seaming chuck, said pinion gear being disposed around an outer periphery of said seaming chuck.

8. An apparatus according to claim 6, wherein said first rotative drive means further comprises a first rail extending from an end of said first rack upstream thereof in said travel path and a first slidable surface coaxial and rotatable with said first pinion gear for positioning said first pinion gear into a position for mesh with said first rack when the first slidable surface engages and slides on said first rail.

9. An apparatus according to claim 6, wherein said second rotative drive means further comprises a second rail extending from an end of said second rack upstream thereof in said travel path, and a second slidable surface coaxial and rotatable with said second pinion gear for positioning said second pinion gear into a position for mesh with said second rack when the second slidable surface engages and slides on said second rail.

10. An apparatus according to claim 6, wherein said first rotative drive means further comprises a first tooth integral and rotatable with said first pinion, and a first engagement member positioned upstream of an end of said first rack in said travel path for rotating said first pinion gear into a position for mesh with said first rack when said first tooth engages said first engagement member.

11. An apparatus according to claim 6, wherein said second rotative drive means further comprises a second tooth integral and rotatable with said second pinion, and a second engagement member positioned upstream of an end of said second rack in said travel path for rotating said second pinion gear into a position for mesh with said second rack when said second tooth engages said second engagement member.

12. An apparatus according to claim 5, wherein said first rotative drive means comprises a first pinion gear integral and coaxial with said axis of the can end holder means, and a first rack extending parallel to said seaming means and including a portion with which said first pinion gear starts to mesh, said portion being elastically swingable horizontally.

13. An apparatus according to claim 5, wherein said second rotative drive means comprises a second pinion gear integral and coaxial with said axis of the can end holder means, and a second rack extending parallel to said seaming means and including a portion with which said second pinion gear starts to mesh, said portion being elastically swingable horizontally.

14. An apparatus according to claim 5, wherein said first rotative drive means comprises a first roll integral and coaxial with said axis of the can end holder means and having a high coefficient of friction, and a first rail extending parallel to said seaming means and having a high coefficient of friction for frictionally engaging said first roll.

15. An apparatus according to claim 5, wherein said second rotative drive means comprises a second roll integral and coaxial with said axis of the can end holder means and having a high coefficient of friction, and a second rail extending parallel to said seaming means and having a high coefficient of friction for frictionally engaging said second roll.

16. An apparatus according to claim 1, wherein said can feed means comprises first can feed means for horizontally supporting the can and feeding the can linearly along a feed path at a predetermined speed, and second can feed means movable on a substantially elliptical endless track having a pair of arcuate tracks and a pair of straight tracks, one of said arcuate tracks extending progressively closer tangentially to said feed path and being joined to said first can feed means, one of said straight tracks extending downstream in said feed path, said second can feed means horizontally supporting the can received from said first can feed means and feeding the can along said straight tracks, said second can feed means being positioned downwardly of said can end feed means and movable in synchronism with said can end feed means.

17. An apparatus according to claim 16, wherein said second can feed means and said can end feed means comprise a plurality of feed blocks connected endlessly, each of said feed blocks comprising said can end holder means in an upper portion and a rotatable support table in a lower portion which is part of said second can feed means, said feed blocks being movable along said substantially elliptical track.

18. An apparatus according to claim 17, wherein said can end holder means and said support table have axes of rotation in said feed block which are aligned with the axis of the can.

19. An apparatus according to claim 17, wherein said can end holder means is vertically movable with respect to said feed block and normally urged to move upwardly, further including means for engaging said can end holder means therealong to lower the can end holder means.

20. An apparatus according to claim 19, wherein said can end holder means has a cam roller, further including a cam rail integral with said seaming means for vertically moving said can end holder means through said cam roller, and lifting/lowering means for vertically moving said cam rail and said seaming means.

21. An apparatus according to claim 1, wherein said seaming means has a provisionally crimping groove.

22. An apparatus according to claim 1, wherein said seaming means has a provisionally crimping groove and a first crimping groove for a double-seaming process.

23. An apparatus according to claim 1, wherein said seaming means has a provisionally crimping groove and first and second crimping grooves for a double-seaming process.

24. An apparatus according to claim 1, wherein said seaming means has a first crimping groove for a double-seaming process.

25. An apparatus according to claim 1, wherein said seaming means has first and second crimping grooves for a double-seaming process.

26. An apparatus according to claim 16, wherein said first can feed means comprises means for gripping the can at front and rear sides thereof with respect to said feed path, and transferring the can onto said second can feed means.

27. An apparatus according to claim 26, wherein said first can feed means comprises mean for releasing the can in a position where the can is transferred onto said second can feed means.

28. An apparatus according to claim 16, wherein said seaming means comprises first seaming means disposed along a forward travel path of one of said straight tracks, and second seaming means disposed along a return travel path of the other straight track.

29. An apparatus according to claim 28, wherein said first and second seaming means comprising means for double-seaming the can end to the can.

30. An apparatus according to claim 29, further including a seaming device for further seaming the can end which has been seamed by said first and second seaming means.

31. An apparatus according to claim 17, wherein each of said feed blocks has a first leading guide roller and a second trailing guide roller positioned in juxtaposed relation for guiding the feed block along said substantially elliptical track, the arrangement being such that when said guide rollers are on one of said straight tracks or one of said arcuate paths, the guide rollers are guided along one track and the first guide roller moves from the arcuate track into the straight track, when the second guide roller is in the arcuate track, the first guide roller is guided into an arcuate track extending outwardly of the straight track, when the second guide roller moves from the arcuate track into the straight track and the first roller is in the straight track, the second guide roller is guided into the straight track, when the first guide roller moves from the straight track into the arcuate track and the second guide roller is in the straight track, the first guide roller is guided into a straight track extending inwardly from the arcuate track, when the second guide roller moves from the straight track into the arcuate track and the first guide roller is in the arcuate track, the second guide roller is guided into an arcuate track extending outwardly from the straight track.

32. An apparatus for seaming a can end to a can, comprising:

a chain of feed blocks each having can end holder means which is positioned in an upper portion thereof and vertically movable and horizontally rotatable, and a can support table which is positioned in a lower portion thereof in confronting relation to said can end holder means and is horizontally rotatable, said feed blocks being movable along a travel path comprising a substantially elliptical track including a pair of arcuate tracks and a pair of straight tracks; and linear seaming means for pressing the can end and the can which are gripped between said can end holder means while the can is fed linearly along said travel path and said support table to seam the can end continuously to the can when the feed blocks are moved along said straight tracks;

and means to enable said filled cylindrical can and said can end to rotate in synchronism against said seaming means only subsequent to said can end being held against said filled cylindrical can.

33. An apparatus for seaming a can end to a filled cylindrical can, comprising:

can feed means for supporting the bottom of the can rotatably about its own axis and feeding the can linearly along a travel path at a predetermined speed;

can end holder means for detachably holding the can end directly above said can feed means and holding the can end rotatably about its own axis;

can end feed means for moving said can end holder means to feed the can end in synchronism with the can which is fed by said can feed means;

lifting/lowering means for lowering said can end holder means to hold the can end held by said can end holder means against an open end of the can;

seaming means extending linearly along said travel path for pressing an end hook of the can end and a flange of the can while the can against which the can end is held is being fed by said can feed means; and drive means for rotating said can end holder means and said can feed means to roll the can end and the can along said seaming means to seam the can end to the can while the end hook of the can end and the flange of the can are being pressed by said seaming means, said drive means includes first rotative drive means for rotating said can end holder means and second rotative drive means for rotating said can feed means in synchronism with the rotation of said can end holder means, said first rotative drive means includes a first pinion gear coaxial with said axis of the can end holder means, and a first rack extending along said seaming means for mesh with said first pinion gear, and wherein said second rotative drive means includes a second pinion gear coaxial with said axis of the can feed means, and a second rack extending along said travel path for mesh with said second pinion gear;

said first rotative drive means further includes a first rail extending from an end of said first rack upstream thereof in said travel path, and a first slidable surface coaxial and rotatable with said first pinion gear for positioning said first pinion gear into a position for mesh with said first rack when the first slidable surface engages and slides on said first rail.

34. An apparatus according to claim 33, wherein said can end holder means and said can feed means are rotatable about an axis aligned with the axis of the can when the can end is held against the can.

35. An apparatus according to claim 33, wherein said can end holder means comprises a seaming chuck, said first pinion gear being disposed around an outer periphery of said seaming chuck.

36. An apparatus according to claim 33, wherein said second rotative drive means further comprises a second rail extending from an end of said second rack upstream thereof in said travel path, and a second slidable surface coaxial and rotatable with said second pinion gear for positioning said second pinion gear into a position for mesh with said second rack when the second slidable surface engages and slides on said second rail.

37. An apparatus according to claim 33, wherein said first rotative drive means further comprises a first tooth integral and rotatable with said first pinion gear, and a first engagement member positioned upstream of an end of said first rack in said travel path for rotating said first pinion gear into a position for mesh with said first rack when said first tooth engages said first engagement member.

38. An apparatus according to claim 33, wherein said second rotative drive means further comprises a second tooth integral and rotatable with said second pinion gear, and a second engagement member positioned upstream of an end of said second rack in said travel path for rotating said second pinion gear into a position for mesh with said second rack when said second tooth engages said second engagement member.

39. An apparatus according to claim 33, wherein said first rotative drive means comprises a first pinion gear integral and coaxial with said axis of the an end holder means, and a first rack extending parallel to said seaming means and including a portion with which said first pinion gear starts to mesh, said portion being elastically swingable horizontally.

40. An apparatus according to claim 33, wherein said second rotative drive means comprises a second pinion gear integral and coaxial with said axis of the can end holder means, and a second rack extending parallel to said seaming means and including a portion with which said second pinion gear starts to mesh, said portion being elastically swingable horizontally.

41. An apparatus according to claim 33, wherein said first rotative drive means comprises a first roll integral and coaxial with said axis of the can end holder means and having a high coefficient of friction, and a first rail extending parallel to said seaming means and having a high coefficient of friction for frictionally engaging said first roll.

42. An apparatus according to claim 33, wherein said second rotative drive means comprises a second roll integral and coaxial with said axis of the can end holder means and having a high coefficient of friction, and a second rail extending parallel to said seaming means and having a high coefficient of friction for frictionally engaging said second roll.

* * * * *